US006135587A

United States Patent [19]

Muhl et al.

[11] Patent Number: 6,135,587

[45] Date of Patent: Oct. 24, 2000

[54] INK JET PRINT HEAD CONFIGURATION

[75] Inventors: Wolfgang Muhl; Michael Seikel, both of Berlin, Germany

[73] Assignee: Francotyp-Postalia Aktiengesellschaft & Co., Birkenwerder, Germany

[21] Appl. No.: 08/987,546

[22] Filed: Dec. 9, 1997

[30] Foreign Application Priority Data

Dec. 9, 1996 [DE] Germany ..... 196 51 048

[51] Int. Cl.[7] ..... B41J 2/16

[52] U.S. Cl. ..... 347/49

[58] Field of Search ..... 347/49, 50; 346/139 R

[56] References Cited

U.S. PATENT DOCUMENTS 5,563,641 10/1996 Plesinger ..... 347/47
5,646,658 7/1997 Thiel et al. ..... 347/49

FOREIGN PATENT DOCUMENTS 0 615 844 A1 9/1994 European Pat. Off. .
0 786 342 A1 7/1997 European Pat. Off. .

OTHER PUBLICATIONS

Japanese Patent Application No. 06316066 A (Eiichiro et al.), dated Nov. 15, 1994.
Japanese Patent Abstract No. 06355548 A(Makoto), dated Dec. 20, 1999.
International Patent Application WO 91/06432 (Lehmann et al.), dated May 16, 1991.
Japanese Patent Abstract No. 06297715 A (Naoto et al.), dated Oct. 25, 1994.

*Primary Examiner*—Arthur T. Grimley
*Assistant Examiner*—Greg Moldafsky
*Attorney, Agent, or Firm*—Herbert L. Lerner; Laurence A. Greenberg; Werner H. Stemer

[57] ABSTRACT

The ink jet print head includes a plurality of modules in a stacked construction or a single module. The modules are disposed in a housing. The nozzle faces of the modules protrude into associated slits of a base plate of the housing, and the modules are electrically connected to a bus adapter. The modules are pressed, by means of a spring element and a common adapter for their ink connection stubs, against an end face of the slits and against the base plate. The assembly is self-adjusting, and its accuracy depends only on the dimensional accuracy of the base plate, the spring element, and a side edge of the modules which is in effect a reference edge.

18 Claims, 6 Drawing Sheets

INK JET PRINT HEAD CONFIGURATION

BACKGROUND OF THE INVENTION

1. Field of the Invention

The invention relates to a configuration for an ink jet print head, which is composed of a plurality of stacked modules, or is equipped with only one module.

Such ink jet print heads are used both in office printers and in small high-speed printers—of the kind needed for postage meters and product labeling devices—and as a rule have a relatively large number of jets.

Precisely in this latter application, high reliability is required, so that errors in printing, which can entail major subsequent costs, are avoided.

A component that has an especially strong influence on the reliability of the printer is the ink jet print head. If the ink jet print head is composed of a plurality of components, the precise arrangement thereof to one another and with one another has a definitive influence on its reliable function. The reliability is also known to increase as the number of individual parts decreases. It is at these two points that the invention comes in.

2. Description of the Related Art

The prior art has known a system wherein, in an ink jet print head composed of a plurality of ink jet printing modules, at least one ribbon conductor is connected to each module by way print control and feeding of electric current are effected from a central point. See, for instance, German patent publications DE 44 43 244 A1 and DE 44 43 245 A1 and U.S. Pat. No. 4,703,333.

Each module of U.S. Pat. No. 4,703,333 has a number of jets and is formed of a plurality of stacked plates with ink jet printing chambers and ink supply conduits machined into them. The module is embodied by the sideshooter principle; that is, the nozzle conduits or nozzle openings extend crosswise through an outer plate. The pressure wave in the ink jet printing chamber is in the direction of the jet channel, so that the ink droplets are expelled orthogonally to the plate. Correspondingly, ink inlet channels and openings for the ink supply are provided crosswise through the outer plate on the opposite side of the module. To that end, an inlet stub is mounted on the plate above each ink inlet openings. The inlet stubs, all in a row, of all the modules are connected to an ink tank via a common adapter and an ensuing ink hose. The adapter is constructed as an ink distributor element. Stubs that are slipped onto the inlet stubs of the modules are located on its ink outlet side. On its ink inlet side, there is one stub, onto which the ink hose is slipped. The problem of equalizing pressure for the ink inlet is not taken into account here. For reasons of both unhindered ink expulsion—via a side wall, because this is a sideshooter—and also the space required for the ink inlet, a staggered arrangement of the modules is necessary for this ink jet print head. In other words, the modules are stacked, inclined, one after another in such a way that the jet region on one side and the ink supply region on the other are free. This in turn dictates a correspondingly large amount of space required.

A receiving frame for the modules is provided which is adapted to the staggered arrangement. The frame has oblique steps—one step per module—and one common opening for the jet region of all the modules. To achieve the lateral offset of the jets relative to one another, the modules are provided with oblong slots through which screws are passed that engage threaded holes in the steps. The modules must be adjusted with a gauge and then locked by means of the screws.

As can be seen from this description, the number of individual parts and the adjustment effort and expense are considerable. A cleaning and sealing station adapted to this ink jet print head will be very complicated in its construction, because of the stepped configuration.

An ink jet print head of stacked construction made of individual identical modules is also known. The modules operate by the edgeshooter principle and are joined together by the "interlaced principle". See European patent disclosure EP 0 615 844 B1.

The modules are secured in a module carrier, held at the spacing from one another by means of spacers. The module carrier has a front panel with one common opening for the nozzle faces of all the modules and with separate fastening elements for each module. Stop edges for the module, offset from one another, are machined into the opening. Each module accordingly has one reference edge with a highly accurate spacing from the first jet of its row of jets. That configuration results in the offset arrangement by the interlaced principle.

The individual module comprises three plates stacked one above the other: a middle plate and two cover plates. The jets are formed into one of the cover plates in such a way that the middle plate forms a jet wall or nozzle wall.

The spacers are attached to the modules in such a way that the rows of jets of the modules are kept equidistant from one another. Three spacers per module are provided, so that the spacing is defined by three-point contact. The spacing is determined by the length of the spacers, since these spacers are in a row, touching one another. The modules are accordingly provided with three continuous bores, through which the spacers are passed. The spacers are also designed such that in the peripheral region they rest on the face of the middle plate of the module that is involved in forming the jets.

In their contact region with the middle plate, the spacers are secured by means of adhesive bonding or soldering.

In this embodiment, the tolerances of the spacers and of the fastening means determine the accuracy of the spacing of the rows of jets from one another. Depending on the number of modules, the tolerances in the chain of tolerances add up.

Finally, it is also known to assemble an ink jet print head from three modules by the "noninterlaced" principle. See Third Annual European Ink Jet Printing Workshop, Maastricht, Holland, Oct. 16–18, 1995. Slits of equal length, which are parallel and aligned with one another and extend obliquely, are made in a front panel, and modules are inserted by their jet region into these slits. The recording carrier is moved past the rows of jets in such a way that the printed image is composed of three stripes one above the other. For a vertical solid line, accordingly the upper third is generated by the first module, the middle third by the second module, and the lower third by the third module.

SUMMARY OF THE INVENTION

It is accordingly an object of the invention to simplify the design configuration of an ink jet print head, broaden its range of application, and improve its servicing properties. Accordingly, the object is to provide a configuration for an ink jet print head, which overcomes the above-mentioned disadvantages of the heretofore-known devices and methods of this general type and which has the simplest possible design, which makes do with only a few individual components, and in which subsequent adjustments of the individual components to one another are dispensed with. It should be possible to make the ink jet print head either from a single module or from a plurality of identical modules in a stacked construction on the edgeshooter principle.

With the foregoing and other objects in view there is provided, in accordance with the invention, an ink jet print head configuration, comprising:

a housing having a base plate formed with slits;

a plurality of substantially identical modules disposed in the housing, the modules being equidistant from and aligned with one another, and having nozzle faces protruding into the slits of the base plate;

a spring element and a common adapter for ink connection stubs of the modules form-locking and force-locking the modules in the housing;

the slits having end faces and the modules having side edges resting against the end faces, and the modules having shoulders formed adjacent the nozzle faces, the shoulders resting on the base plate inside the housing such that the nozzle faces project through the slits at least to a plane defined by an outside surface of the base plate; and a bus adapter forming an electrical connection with the modules.

In accordance with an added feature of the invention, each of the modules comprises two switch modules and an ink jet printing module sandwiched between the switch modules, and a plurality of common terminals connecting the switch modules to a bus board of the bus adapter.

In accordance with an additional feature of the invention, a ribbon conductor is connected to the bus board, and a plug connector is provided for connecting the switch modules to a microcomputer.

In accordance with another feature of the invention, each of the ink jet printing modules includes an ink connection stub disposed parallel to a side edge thereof, the adapter being placed in a resilient rubber-elastic fashion on the ink connection stub, and the adapter having a flange with a stub for receiving thereon an ink hose communicating with an ink tank, the adapter being detachably secured in the housing.

In accordance with a further feature of the invention, each of the ink jet printing modules comprises three stacked plates each having a lateral tab for mechanically and fluidically coupling the ink connection stub; and the ink connection stub having a flange part and a tube part with a rubber-elastic sealing sheath slipped thereon, and a substantially U-shaped clamp for securing the flange part to the respective ink jet printing module;

the flange part is thereby formed with a recess for the stacked tabs and with a bead for locking the clamp;

the clamp is thereby force-locked on one side against the bead and on the other the against one of the tabs; and the sealing sheath is thereby a hat-shaped sheath with a shaft and an edge, the shaft resting on a shoulder of the flange part.

In accordance with again an added feature of the invention, the housing comprises a frame, a cap, and the base plate;

the frame is provided with screw bushes for securing the adapter and screw bushes for securing the cap, and pawls for the spring element; and the base plate is secured in the frame by a snap connection.

In accordance with again an additional feature of the invention, the spring element is a one-piece, box-shaped stamped and bent stainless steel part, having a rectangular back wall, a pair of mutually facing side walls each having a wedge shape and being bent orthogonally from the back wall;

a side wall, bent orthogonally from the back wall, having a slit formed therein, and being bent orthogonally outward; and a further side wall bent orthogonally away from the back wall and being bent obliquely inward.

In accordance with again another feature of the invention, the housing has a compartment with ribs formed therein for receiving the spring element;

the back wall is provided with at least one recess adapted to the pawl;

the spring element, in an inserted position thereof, rests with its side walls and its back wall on the ribs, and the pawl protrudes into the recess;

the slit side wall has one resilient holding-down device for each of the modules, the holding-down device comprising two mutually parallel legs and a crossbar connecting the legs;

each module with its ink jet printing module is retained on an outside between the legs of the holding-down device, and the crossbar of the holding-down device rests in force-locking fashion on an upper edge of the ink jet printing module and thereby presses the module, with the shoulder located below, against the base plate;

the lower side wall has a resilient contact-pressure tab for each module, the contact-pressure tab pressing the ink jet printing module with its side edge against an end face of the slit in the base plate;

the adapter resting in force-lock on the ink connection stubs and pressing the ink jet printing modules, with the shoulders located beneath, against the base plate;

the adapter comprising a base body formed with fastening holes and a flange with a stub; and the flange is screwed to screw bushes and the stub is adapted to receive an ink hose.

In accordance with a concomitant feature of the invention, each of the modules, at the slits in the base plate, is surrounded with a compensation and sealing composition sealing off the slit on an inside and an outside.

A simple, self-adjusting assembly is attained in that in a housing, identical modules with a single precise reference edge are inserted in force-locking and form-locking fashion into associated equidistant slits in the base plate with a stop. The elastic retention by means of a common adapter, which is present and required anyway, for the ink connection stubs of the modules and of a single spring element, which is embodied as a one-piece stamped and bent part, has not only the advantages named above but still others. Since the modules are inserted merely by exerting spring forces rubber—elastic coupling of the adapter and spring-elastic coupling by the stainless steel spring element—overloading and damage of the modules are reliably avoided, and a separation is achieved between the very stringent tolerance requirements for the module and the relatively low tolerance requirements for the fastening of the retaining elements.

The spring element can be manufactured to the required accuracy using a suitable follow-on tool for an arbitrary number of modules without particular difficulties, because only the leg spacing dimension of the holding-down devices has to be adhered to. With the holding-down devices, the modules are not only pressed by their shoulders against the base plate but are also kept equidistant in the region remote from the jet nozzle region.

With the above and other objects in view there is also provided, in accordance with the invention, an ink jet print head configuration with a single module. The assembly comprises:

a housing having a base plate formed with a slit;

a module disposed in the housing, the module having a nozzle face protruding into the slit of the base plate;

a spring element and an adapter for an ink connection stub form-locking and force-locking the module in the housing;

the slit being formed with an end face and the module having a side edge resting against the end face, and the module having a shoulder formed adjacent the nozzle face, the shoulder resting on the base plate inside the housing such that the nozzle face projects through the slit at least to a plane defined by an outside surface of the base plate; and a bus adapter forming an electrical connection with the module.

When the ink jet print head is made with only one module, the situation is correspondingly simpler. The module is analogously retained by means of an adapter for only one ink connection stub and one spring element, with only one holding-down device.

Depending on the conditions of use, it would also be possible for a housing designed for a certain number of modules to be only partially equipped. At least the spring element could then remain unchanged, and only the base plate and the adapter would have to be adapted. It would also be possible to use only one type of base plate and to seal up the unneeded slits.

Securing the base plate in the frame of the housing using a snap connection is easy from an assembly standpoint and allows easy replacement of the contents.

Other features which are considered as characteristic for the invention are set forth in the appended claims.

Although the invention is illustrated and described herein as embodied in a configuration for an ink jet print head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3A is an enlarged view of the detail III in FIG. 3;

FIG. 4A is an enlarged view of the detail IV in FIG. 4;

DESCRIPTION OF THE PREFERRED EMBODIMENTS

Figure 1:
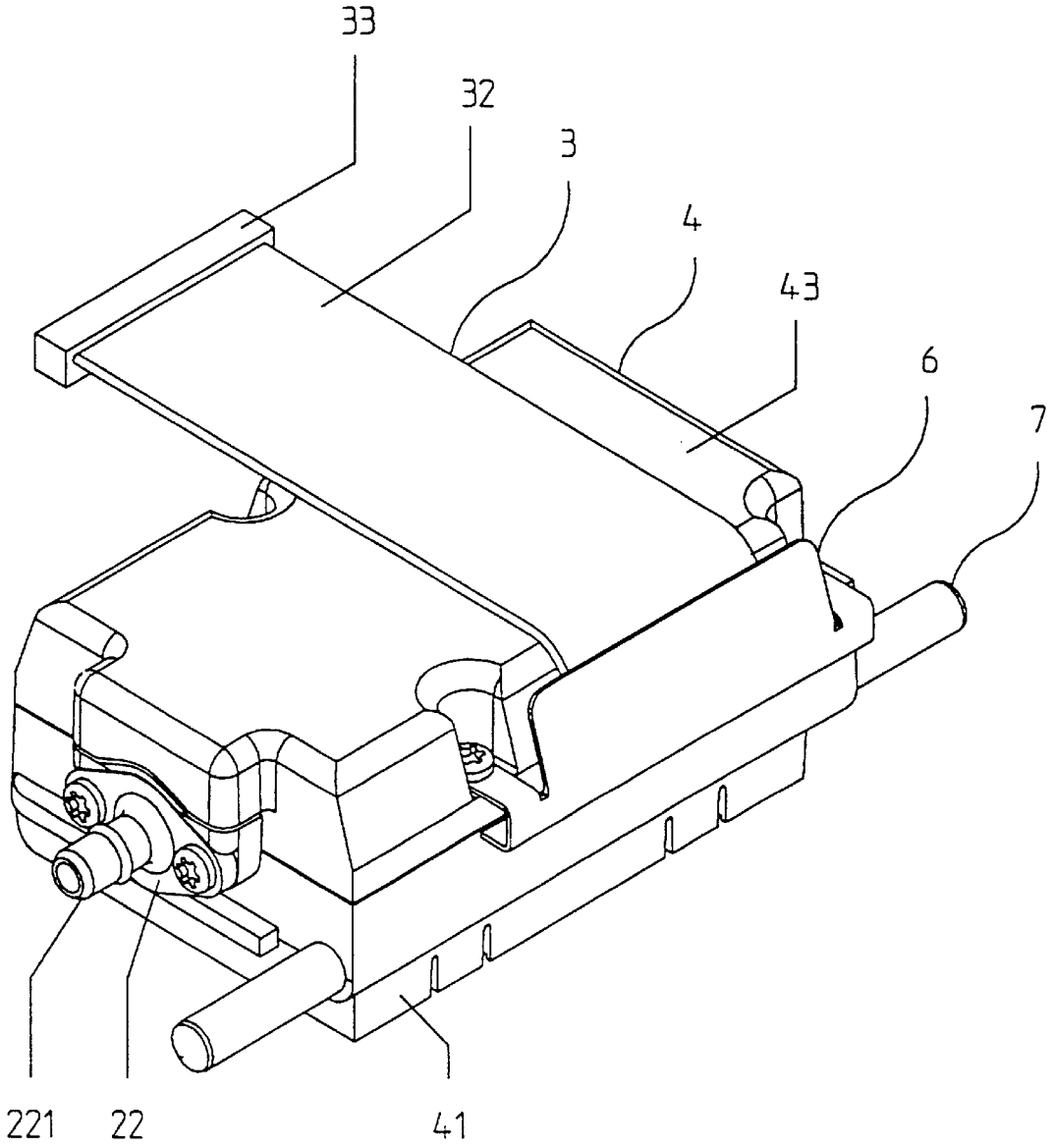
FIG. 1 is a perspective view of an ink jet print head in a closed housing.

Referring now to the figures of the drawing in detail which, for simplification and easier comprehension, are partly schematic, and first to FIG. 1 thereof, there is seen an ink jet print head illustrated as a structural unit. The ink jet print head comprises a closed housing 4, with an ink connection formed with a flange 22 having a stub 221, forming a part of an adapter 2;

an electrical terminal in the form of a ribbon conductor 32 with a plug connector 33, forming a part of a bus adapter 3;

an angle 6 for guiding the ribbon conductor; and a pivot shaft 7 for selectively adjusting the ink jet print head to a printing position or a cleaning and closure position.

Figure 3:
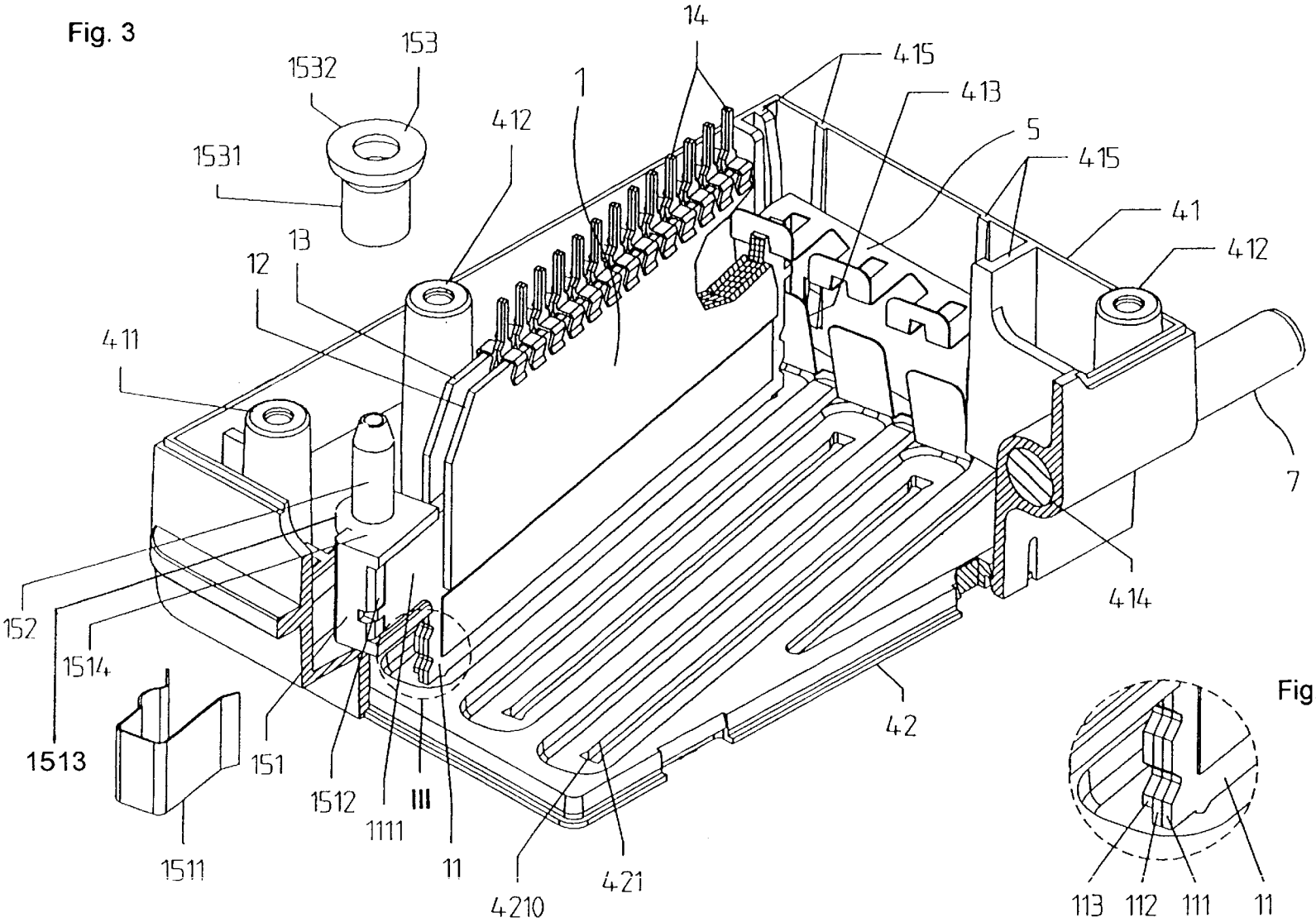
FIG. 3 is a partly sectional, partly exploded view of the ink jet print head of FIG. 2 with the cap removed, partially equipped with one module.

The housing 4 is composed of a frame 41, a base plate 42 which is visible only in FIG. 3, and a cap 43.

Figure 2:
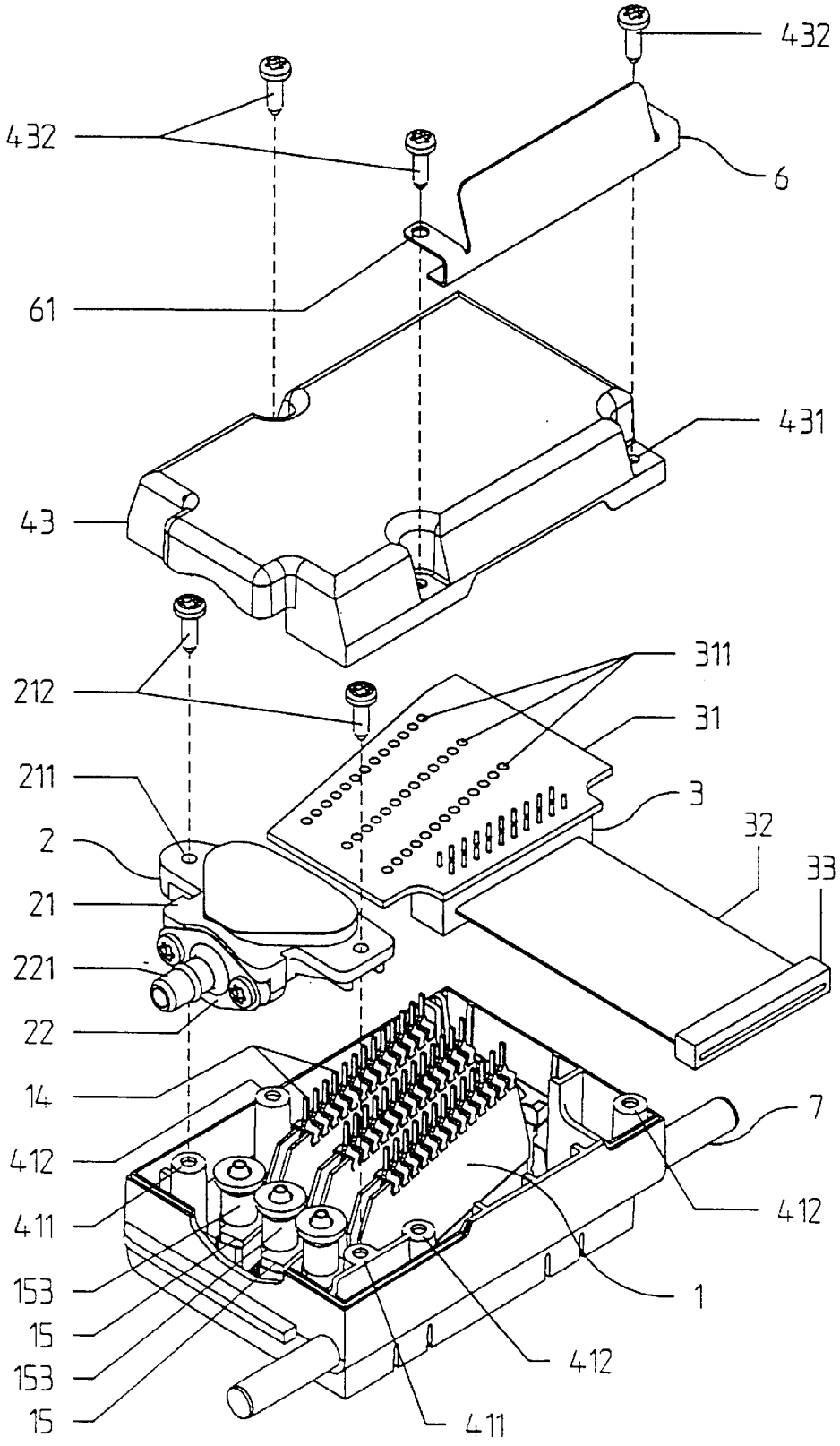
FIG. 2 is a partly exploded view of an ink jet print head with three modules.

With reference to FIG. 2, three modules 1 are disposed in the housing 4 obliquely, in alignment with one another and equidistant from one another. The modules 1 protrude with their terminals 14 into associated bores 311 of a bus board 31. The terminals 14 are soldered to the bus board 31. The bus board 31 is a component of the bus adapter 3, which is connected to a central controller and electric power supply via the ribbon conductor 32 and the plug connector 33.

In this way, the modules 1 are connected electrically to one another and to the central controller.

Ink connection stubs 15 are mounted parallel to one side edge of the modules 1. The stubs 15 communicate with one another and with an ink supply by means of the common adapter 2.

The adapter 2 is secured by its base body 21, which has fastening holes 211, by means of screws 212 to associated screw bushes 411. The screw bushes 411 are formed onto the frame 41.

Screw bushes 412 are correspondingly formed onto the frame 41 for securing the cap 43. The cap 43 and the angle 6 are secured together by means of screws 432. To that end, both of them have fastening holes 431, 61 spaced equidistantly.

As shown in FIG. 3, a module 1 comprises an ink jet printing module 11 and switch modules 12, 13 (circuit modules), disposed on either side of it, along with the common terminals 14.

The ink connection stub 15 is secured to a side edge 110 of the ink jet printing module 11, parallel to this edge, by means of a U-shaped clamp 1511 of a stainless spring steel. The ink connection stub 15 has a flange part 151 and a tube part 152, onto which a hat-shaped sealing sheath 153 of a rubber-elastic material, such as silicone rubber, is slipped. The sealing sheath 153 rests on one side with its shaft 1531 on a shoulder 1514 of the flange part 151 and on the other with its edge 1532 on the base body 21 of the adapter 2; see also FIG. 2.

Figure 6:
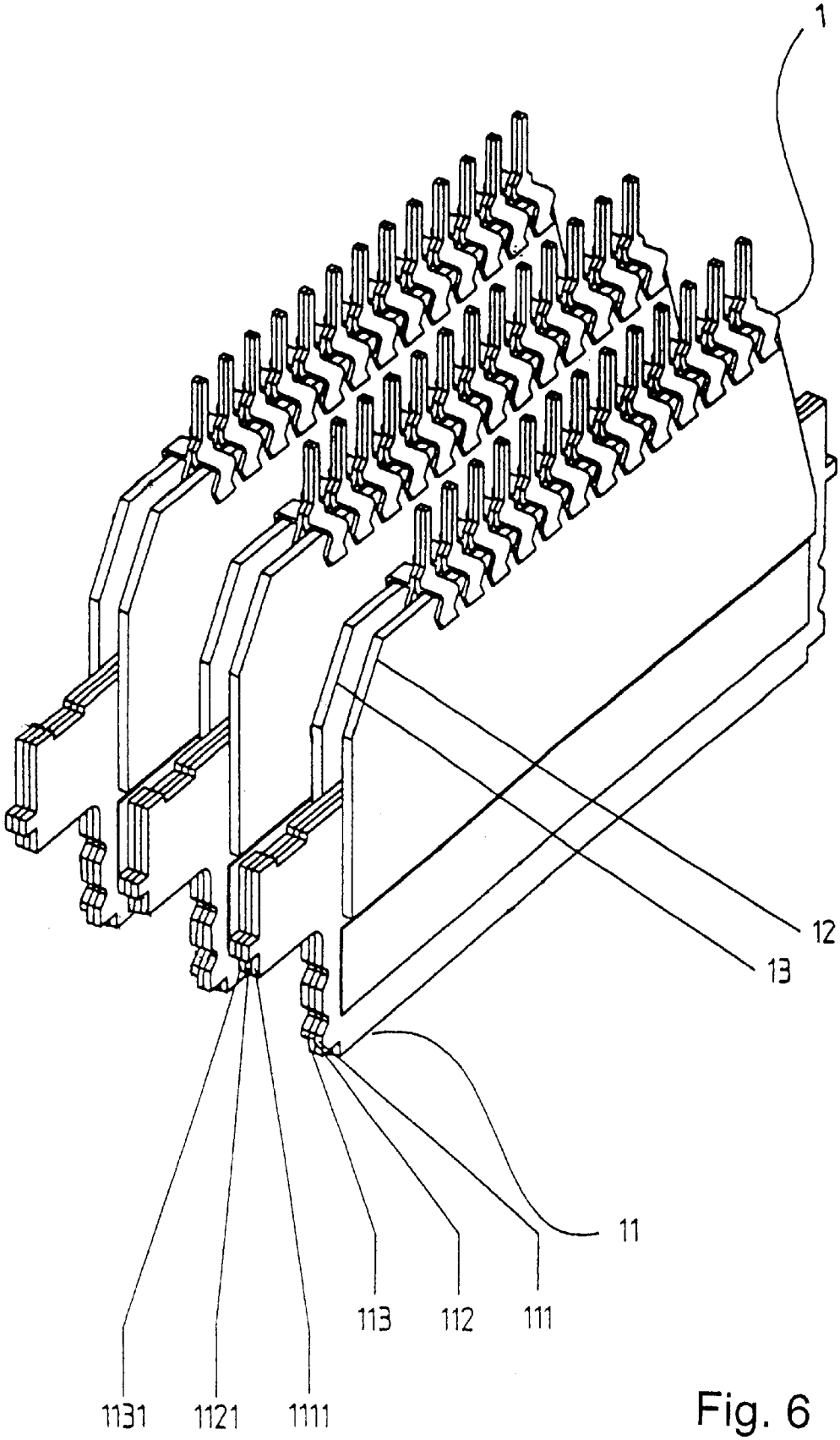
FIG. 6 is a perspective view of three modules.

Referring to FIG. 6. it can be seen that the ink jet printing module 11 comprises three plates 111, 112, 113, which are stacked on one another or in line with one another, and which for the sake of mechanical and fluidic coupling of the ink connection stub 15 with respective lateral tabs 1111, 1121, 1131.

Referring again to FIG. 3, the flange part 151 of the ink connection stub 15 is provided on the one side with a recess 1512 for receiving the in-line tabs 1111, 1121, 1131 (FIG. 6) of the ink jet printing module 11 and one leg of the clamp 1511. On the other side the stub 15 is provided with a bead 1513 for locking the other leg of the clamp 1511. The clamp rests in form-locking and force-locking fashion on the side of the flange having the bead 1513, on the one hand, and on an outer, closed, smooth tab 1111, on the other.

Each ink jet printing module 11 protrudes with its nozzle face 10 into the slit 421, assigned to this module, of the base plate 42 and is pressed by the spring element 5 against an end face 4210 of the slit 421.

By means of ribs 415 formed on the frame 41, a compartment is formed for receiving the spring element 5. The spring element is inserted like a drawer into this compartment and is retained in form-locking fashion by means of pawls 413 present on the frame 41.

In a thickened portion of a longitudinal wall of the frame 41, a bore 414 is provided, for receiving the pivot shaft 7 for the ink jet print head.

Figure 4:
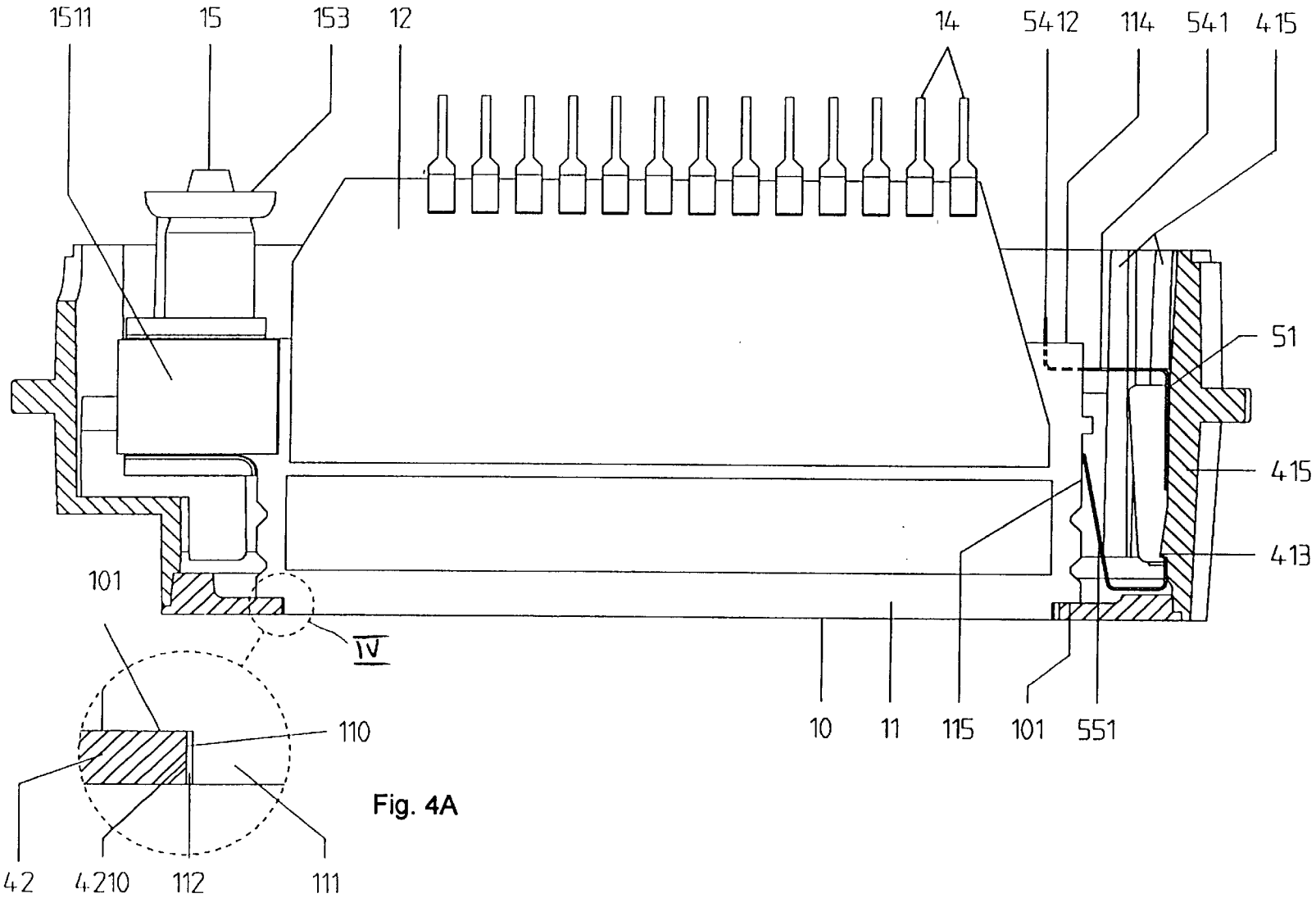
FIG. 4 is a longitudinal section through the ink jet print head of FIG. 2.

It is readily apparent in FIG. 4 how the ink jet printing module 11 is inserted into the slit 421 of the base plate 42. The ink jet printing module 11 is thrust so far into the slit 421 that its nozzle face 10 is at least in the same plane as the outer face of the base plate 42, or protrudes beyond it. In this way, cleaning of the nozzle face 10 by means of a wiper lip is made possible for the first time, and what is wiped off is kept away from this face.

The ink jet printing module 11 rests with both shoulders 101, formed by all the plates 111, 112, 113, on the base plate 42 and rests with a side edge 110 of the middle plate 112 containing the jets on the end face 4210 of the slit 421 in the base plate 42.

The contact pressure against the base plate 42 is generated jointly by the adapter 2 and the spring element 5.

Figure 5:
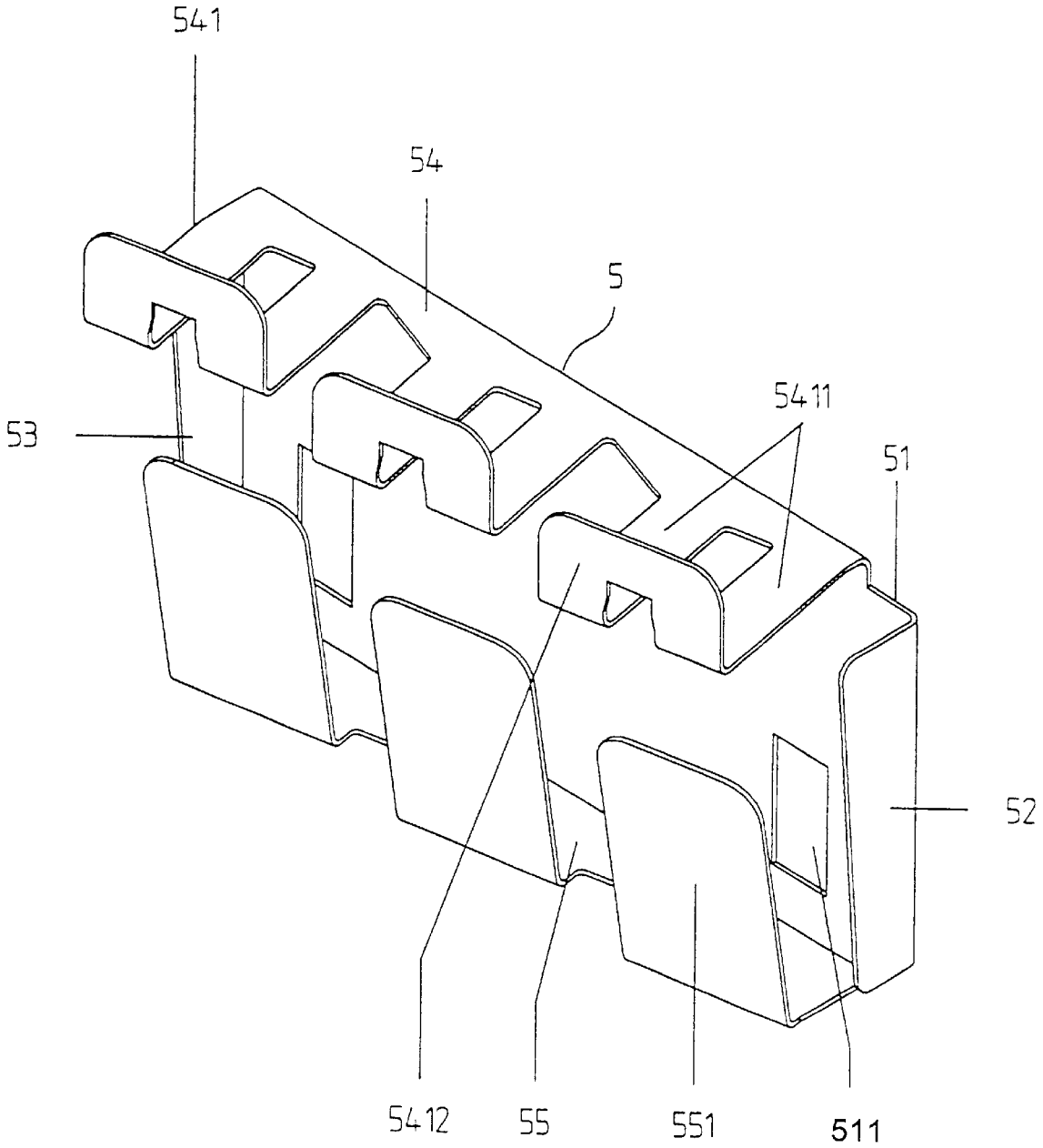
FIG. 5 is a perspective view of a spring element for three modules.

In detail, the spring element 2 rests with the holding-down device 541, or its crossbar 5412, on the top edge 114 and rests with the contact-pressure tabs 551 against a second side edge 115 of the ink jet printing module 11; see also FIG. 5.

The spring element 5 is made in the form of a one-piece, boxlike stamped and bent part made of some ink-resistant spring material, such as stainless steel.

The spring element 5 has a rectangular back wall 51 and side walls 52, 53, 54, 55 bent orthogonally away from the back wall 51. The back wall 51 is provided with two rectangular recesses 511 for the pawls 413 on the frame 41.

The side walls 52, 53 are wedge-shaped in the direction of insertion of the spring element 5 and face one another.

The upper side wall 54 is slit and is bent orthogonally away toward the outside on the ends, thus forming one holding-down device 541 for each module 1. The holding-down device 541 comprises two parallel legs 5411 and one crossbar 5412 closing them off. Once the spring element 5 is inserted, the legs 5411 embrace the ink jet printing module 11 in the region of the second side edge 115; see also FIGS. 3 and 4.

The lower side wall 55 is likewise slit, but is bent obliquely inward on its ends, thus forming one contact-pressure tab 551 for each module 1. As already explained above, the single contact-pressure tab 551 presses against the side edge 115 of the ink jet printing module 11.

When the modules 1 are inserted in the slits 421, then upon insertion of the spring element 5 into the compartment formed by the ribs 415, all the ink jet printing modules 11 are both aligned and adjusted at the same time. When the adapter is screwed on, this merely provides additional fixation for the modules 1.

A compensation and sealing composition that seals off the slit 421 from the inside and the outside is placed in the remaining interstices between the module 1 and the slit 421. This prevents ink from reaching vulnerable parts of the ink jet print head. On the other hand, this creates a tight front face, which allows cleaning of the ink jet print head using vacuum priming.

The conditions for embodying the ink jet print head with only one module 1 can be learned from FIG. 3. The unoccupied slits 421 in the base plate 42 are then sealed off, and the adapter 2 needs merely to be designed for one ink jet printing module 11.

It will be appreciated that in an ink jet print head having only one module 1 with a sufficient number of jet nozzles, the effort and expense for triggering can be reduced substantially, and there will be a greater range of application, especially for product labeling devices.

We claim:

1. An ink jet print head, comprising:

a housing having a base plate formed with slits;

a plurality of substantially identical modules disposed in said housing, said modules being equidistant from and aligned with one another, and having nozzle faces protruding into respective said slits of said base plate;

a spring element and a common adapter for ink connection stubs of said modules, said spring element form-locking and force-locking said modules in said housing;

said slits having end faces and said modules having side edges resting against said end faces, and said modules having shoulders formed adjacent said nozzle faces, said shoulders resting on said base plate inside said housing such that said nozzle faces project through said slits at least to a plane defined by an outside surface of said base plate; and a bus adapter forming an electrical connection with said modules.

2. The ink jet print head according to claim 1, wherein each of said modules comprises two switch modules and an ink jet printing module sandwiched between said switch modules, and a plurality of common terminals connecting said switch modules to a bus board of said bus adapter.

3. The ink jet print head according to claim 2, which further comprises a ribbon conductor connected to said bus board, and a plug connector for connecting said switch modules to a microcomputer.

4. The ink jet print head according to claim 1, wherein each of said modules includes an ink connection stub disposed parallel to a side edge of each of said modules, said adapter being placed in a resilient rubber-elastic fashion on said ink connection stub, and said adapter having a flange with a stub for receiving thereon an ink hose communicating with an ink tank, said adapter being detachably secured in said housing.

5. The ink jet print head according to claim 4, wherein each of said modules comprises three stacked plates each having a lateral tab for mechanically and fluidically coupling said ink connection stub; and said ink connection stub having a flange part and a tube part with a rubber-elastic sealing sheath slipped thereon, and a substantially U-shaped clamp for securing said flange part to each of said modules;

wherein said flange part is formed with a recess for said stacked tabs and with a bead for locking said clamp;

wherein said clamp is force-locked on one side of said flange against said bead and on the other side of said flange against one of said tabs; and wherein said sealing sheath is a hat-shaped sheath with a shaft and an edge, said shaft resting on a shoulder of said flange part.

6. The ink jet print head according to claim 1, wherein said housing comprises a frame, a cap, and said base plate;

wherein said frame is provided with screw bushes for securing said adapter and screw bushes for securing said cap, and pawls for securing said spring element; and wherein said base plate is secured in said frame by a snap connection.

7. The ink jet print head according to claim 1, wherein said spring element is a one-piece, box-shaped stamped and bent stainless steel part, having a rectangular back wall, a pair of mutually facing side walls each having a wedge shape and being bent orthogonally from said back wall;

a side wall, bent orthogonally from said back wall, having a slit formed therein, and being bent orthogonally outward; and a further side wall bent orthogonally away from said back wall and being bent obliquely inward.

8. The ink jet print head according to claim 7, wherein said housing has a compartment with ribs formed therein for receiving said spring element;

said back wall is provided with at least one recess adapted to a pawl on a frame of said housing;

said spring element, in an inserted position, rests with its side walls and its back wall on said ribs, and said pawl protrudes into said recess;

said side wall with said slit has one resilient holding-down device for each of said modules, said holding-down device comprising two mutually parallel legs and a crossbar connecting said legs;

each of said modules is retained between said legs of said holding-down device, and said crossbar of said holding-down device rests in force-locking fashion on an upper edge of each of said modules and thereby presses each of said modules, with the shoulder located below, against said base plate;

said further side wall has a resilient contact-pressure tab for each of said modules, said contact-pressure tab pressing each of said modules with its side edge against an end face of each of said slits in said base plate;

said adapter resting in force-lock on said ink connection stubs and pressing each of said modules, with the shoulders located beneath, against said base plate;

said adapter comprising a base body formed with fastening holes and a flange with a stub; and said flange is screwed to screw bushes and said stub is adapted to receive an ink hose.

9. The ink jet print head according to claim 1, wherein each of said modules, at said slits in said base plate, is surrounded with a compensation and sealing composition sealing off said slit on the inside and the outside of the base plate.

10. An ink jet print head, comprising:

a housing having a base plate formed with a slit;

a module disposed in said housing, said module having a nozzle face protruding into said slit of said base plate;

a spring element and an adapter for an ink connection stubs, said spring element form-locking and force-locking said module in said housing;

said slit being formed with an end face and said module having a side edge resting against said end face, and said module having a shoulder formed adjacent said nozzle face, said shoulder resting on said base plate inside said housing such that said nozzle face projects through said slit at least to a plane defined by an outside surface of said base plate; and a bus adapter forming an electrical connection with said module.

11. The ink jet print head according to claim 10, wherein said module comprises two switch modules and an ink jet printing module sandwiched between said switch modules, and a plurality of common terminals connecting said switch modules to a bus board of said bus adapter.

12. The ink jet print head according to claim 11, which further comprises a ribbon conductor connected to said bus board, and a plug connector for connecting said switch modules to a microcomputer.

13. The ink jet print head according to claim 10, wherein said module includes an ink connection stub disposed parallel to a side edge of said module, said adapter being placed in a resilient rubber-elastic fashion on said ink connection stub, and said adapter having a flange with a stub for receiving thereon an ink hose communicating with an ink tank, said adapter being detachably secured in said housing.

14. The ink jet print head according to claim 13, wherein said module comprises three stacked plates each having a lateral tab for mechanically and fluidically coupling said ink connection stub; and said ink connection stub having a flange part and a tube part with a rubber-elastic sealing sheath slipped thereon, and a substantially U-shaped clamp for securing said flange part to said module;

wherein said flange part is formed with a recess for said stacked tabs and with a bead for locking said clamp;

wherein said clamp is force-locked on one side of said flange against said bead and on the other side of said flange against one of said tabs; and wherein said sealing sheath is a hat-shaped sheath with a shaft and an edge, said shaft resting on a shoulder of said flange part.

15. The ink jet print head according to claim 10, wherein said housing comprises a frame, a cap, and said base plate;

wherein said frame is provided with screw bushes for securing said adapter and screw bushes for securing said cap, and pawls for securring said spring element; and wherein said bas e plate is secured in said frame by a snap connection.

16. The ink jet print head according to claim 10, wherein said spring element is a one-piece, box-shaped stamped and bent stainless steel part, having a rectangular back wall, a pair of mutually facing side walls each having a wedge shape and being bent orthogonally from said back wall;

a side wall, bent orthogonally from said back wall, having a slit formed therein, and being bent orthogonally outward; and a further side wall bent orthogonally away from said back wall and being bent obliquely inward.

17. The ink jet print head according to claim 16, wherein said housing has a compartment with ribs formed the rein for receiving said spring element;

said back wall is provided with at least one recess adapted to a pawl on a frame of said housing;

said spring element, in an inserted position, rests with its side walls and its back wall on said ribs, and said pawl protrudes into said recess;

said side wall with said slit has a resilient holding-down device for said module, said holding-down device comprising two mutually parallel legs and a crossbar connecting said legs;

said module is retained between said legs of said holding-down device, and said crossbar of said holding-down device rests in force-locking fashion on an upper edge of said module and thereby presses said module, with the shoulder located below, against said base plate;

said further side wall has a resilient contact-pressure tab for said module, said contact-pressure tab pressing said module with its side edge against an end face of said slit in said base plate;

said adapter resting in force-lock on said ink connection stub and pressing said module, with the shoulder located beneath, against said base plate;

said adapter comprising a base body formed with fastening holes and a flange with a stub; and said flange is screwed to screw bushes and said stub is adapted to receive an ink hose.

18. The ink jet print head according to claim 10, wherein said module, at said slit in said base plate, is surrounded with a compensation and sealing composition sealing off said slit on the inside and the outside of said base plate.

* * * * *